United States Patent [19]

Roy

[11] Patent Number: 4,988,316

[45] Date of Patent: Jan. 29, 1991

[54] ELECTRICAL CONNECTOR WITH EXTERNALLY APPLIED RADIAL LOCK

[75] Inventor: Dhirendra C. Roy, Canton, Mich.

[73] Assignee: United Technologies Automotive, Inc., Dearborn, Mich.

[21] Appl. No.: 407,485

[22] Filed: Sep. 14, 1989

[51] Int. Cl.[5] ..... H01R 13/426; H01R 13/428

[52] U.S. Cl. ..... 439/744; 439/595

[58] Field of Search ..... 439/595, 733, 744, 745, 439/750–752

[56] References Cited

U.S. PATENT DOCUMENTS 4,772,229 9/1988 Nix et al. ..... 439/733

4,867,711 9/1989 Yuasa ..... 439/744 X

*Primary Examiner*—Eugene F. Desmond

[57] ABSTRACT

A subminiature electrical connector for use particularly in the automotive industry including an insulating plastic body (3) housing an exemplary three terminal pins (1A–C), which are initially locked into place by resilient internal fingers (6) having outwardly directed locking tabs (6A), which are lockingly engaged into inner openings (19) in the terminal pins. After the terminal pins have been inserted and seated, a resilient, exteriorly applied radial locking ring (4) is applied about the body, laterally straddling it, providing a second, double lock for the terminal pins. The locking rings include three, inwardly directed, radial tabs (42A–C) which extend through external body openings (3A) and which lockingly extend into outer, mating openings (18) in the terminal pins. The radial finger tabs and the radial ring tabs are oppositely positioned and conjunctively provide a double lock on each of the pins seated within the connector body. Circumferentially extending guide rails (11) properly longitudinally locate the radial lock on the exterior of the body. The body (16) of the terminal pin in its central, mechanical load bearing area (16) is preferably rectangular in its lateral cross-section, with the outer and inner, female locking openings (18, 19) and mating male tabs (42, 6A) having appropriate geometry with direct, positive, straight edge, face-to-face, orthogonal, locking interfacing with the front edges of the windows.

15 Claims, 4 Drawing Sheets

ELECTRICAL CONNECTOR WITH EXTERNALLY APPLIED RADIAL LOCK

REFERENCE TO RELATED APPLICATION

This application relates to some of the same subject matter as U.S. Pat. No. 4,955,827, entitled "Double-Locked Subminiature Terminal Pin," by the same inventor hereof and another (George E. Hyde) and filed concurrently herewith, the disclosure of which is incorporated herein by this reference.

1. Technical Field

The present invention relates to electrical connector systems for electrically interconnecting a number of wires terminating in pin terminals to a block having mating female connectors, and more particularly to such connectors which are subminiature in size. Even more particularly, the present invention is directed to an electrical connector system which utilizes an externally applied radial lock to lock the terminal pin(s) to the body of the connector, especially for electrical connectors used in the automotive industry.

2. Background Art

To resolve electrical component packaging problems, industries, particularly the automotive industry, use electrical connectors with reduced sizes. In particular, subminiature connectors are often highly desirable. An exemplary size of a subminiature three-way connector would be a connector body having an outer diameter of the order of a half an inch (½"), with each of the three terminal pins having a diameter of the order of one and a half millimeters (1.5 mm) as required by electrical loading situations.

In certain cases, such size reduction can lead to, among others, two potential problems:

1. terminal pushout; and
2. terminal pullout.

Terminal pushout occurs in general during the mating process, while pullout occurs in general during the handling process in the plants. To avoid the problems of terminal pushout and/or pullout, some manufacturers in the automotive industry call for the terminals to be able to withstand a minimum of, for example, a twenty two pound (22 lb.) force.

A variety of technical solutions have been suggested and implemented with some acceptable results. However, these are limited to certain connector sizes and are not applicable to connector systems of subminiature sizes, which is the preferred application of the present invention. Another important fact to be noted here is that an insert molded terminal and connector system (i.e., where terminals and the connector are molded together and appear to be an integrated unit) of subminiature range shows high retention. However, from a serviceability standpoint, such insert molded systems are not desirable.

For general background information, reference is had to the following patents (there of course being many other patents relevant to the art of electrical connector systems):

| Patent No. | Patentee(s) | Issue Date |
|---|---|---|
| 3,434,098 | Schumacher | 03/1969 |
| 3,686,619 | McCardell et al | 08/1972 |
| 4,343,523 | Cairns et al | 08/1982 |
| 4,398,073 | Botz et al | 08/1983 |
| 4,431,244 | Anhalt | 02/1984 |

-continued

| Patent No. | Patentee(s) | Issue Date |
|---|---|---|
| 4,557,542 | Coller et al | 12/1985 |
| 4,565,416 | Rudy | 01/1986 |
| 4,602,837 | Sian et al | 07/1986 |
| 4,714,437 | Dyki | 12/1987 |
| 4,810,205 | O'Grady | 03/1989 |

In most instances, the current state of the art uses a one (1) way locking system in conjunction with a spacer or wedge, often called a secondary lock, which should not be confused with the double locking of the present invention, which is based on different principles.

The Dyki patent perhaps best exemplifies the prior art. In its most preferred embodiment (FIGS. 2–14) the connector body includes on the interior side of its outer wall an inwardly directed, outboard ramping retention abutment 12 in the form of an arcuate wall, which engages (note FIGS. 4, 13 and 14 of Dyki) an annular or circular external recess 18 (note FIG. 11) on the terminal pin 16, engaging at least one-quarter (¼) of the circumference of the external recess.

Integral, elastically deformable, terminal guide fingers 20 are provided in the center interior of the connector body to assist in the positioning of the terminal pins as they are inserted into the connector body. In particular, in order for a terminal pin to pass its respective obstructing arcuate wall abutment 12, the terminal pin must move to the side in a non-orthogonal manner, i.e., at an acute angle to or away from the longitudinal axis of the connector body (note FIG. 11), so that it can pass the obstruction. The elastic deformation of the finger 20 allows this.

It is important to note that the terminal pins shown in Dyki were of a standard, off-the-shelf terminal pin design, and the external recesses 18 of Dyki were made in the form of a reduced neck, and were not in the form of the custom openings or windows into the interior of the terminal pin, as in the present invention. It is also important to note that the engagement between the arcuate walls 12 and the recesses 18 were all external engagements, and that the arcuate walls did not extend into the interiors of the pins defined by the exterior wall surfaces of the pins.

In an alternate embodiment (see FIG. 15 of Dyki) for increasing the retention force, an outwardly directed, inboard ramping retention abutment 14 is included on each one of the centrally located terminal guide fingers 20 to fit in the external recess opposite to the external recess 18 into which the arcuate wall fits. However, as admitted in the Dyki patent:

> "It should be understood, however, that the addition of the inboard retention abutments 14 will cause the overall diameter of the connector to be increased. This increase may not be desirable in certain applications and may, therefore, preclude inclusion in the connector of the inboard ramping retention abutments."

Thus, in essence, the Dyki patent taught away from using such a double abutted arrangement where size is a consideration, which is particularly so in subminiature connectors and terminals, the preferred application of the present invention.

It is noted that the patent to Dyki, as well as the patents to Coller et al (note FIG. 2 of Coller) and O'Grady (note FIG. 3 of O'Grady) and possibly others, describe connectors which use internal, resilient finger latches to hold a terminal pin to the body of the connector, which is one aspect preferably used in the present invention; while the Rudy patent discloses the use of internal latching ledges (note 46 and 48 of FIGS. 2 and 3 of Rudy) carried by resilient wall sections 42.

In contrast to the prior art and in particularly the Dyki patent, the present invention achieves double-locking with inter-engaged, male-to-female coupling, not just mere external abutting engagement and achieves such firm, reliable double-locking without adding significantly, if at all, to the external size, i.e. the outer diameter, of the connector body.

DISCLOSURE OF INVENTION

The present invention is directed to an exteriorly applied, radial lock applicable to a multi-way, electrical connector system, particularly of a subminiature size. The construction provides high retention and can also be used, if desired, in conjunction with a second locking mechanism, namely an internal finger latch, to further enhance the locking aspects of the connector. The terminal retention can thus theoretically be two times higher than that which the existing art generally offers.

To achieve this goal, the preferred, exemplary embodiment of the invention uses a radial ring lock which is applied to the exterior of the connector body into which terminal pins have already been inserted into appropriately configured pin cavities in the connector body. The resilient ring lock includes a number of inwardly directed, locking tabs which extend through openings in the connector body, allowing the male tabs to be lockingly inserted into and coupled with outer, mating, open, female openings in the main body of the pins, with there being one inwardly directed, radial tab for each pin. The radial tab engagement with the pin effectively lock the pin to the body.

For the preferred double locking, the radial ring and its associated tabs and openings are located directly opposite to the internal finger engagements with the terminal pins, resulting in the two locking engagement tabs being oppositely directed.

The configuration of the terminal pin in its area where the locking engagements occur is preferably a rectilinear quadrilateral (either rectangular or square in its lateral configuration) with the locking openings in it likewise preferably being rectangular or square.

Circumferentially extending guide rails are preferably included on the exterior of the body to radially slide and properly locate the locking ring with respect to the longitudinal extent of the body, i.e., along its length.

It is thus a basic object of the present invention to design a connector system especially of subminiature range that provides for easy serviceability and simultaneously represents an optimum terminal retention mechanism, which is particularly useful for subminiature automotive applications, but also can be used elsewhere, if so desired.

Other features and advantages will be apparent from the specification and claims and from the accompanying drawings, which illustrate at least one exemplary embodiment of the invention.

BEST MODE FOR CARRYING OUT THE INVENTION

Figure 1:
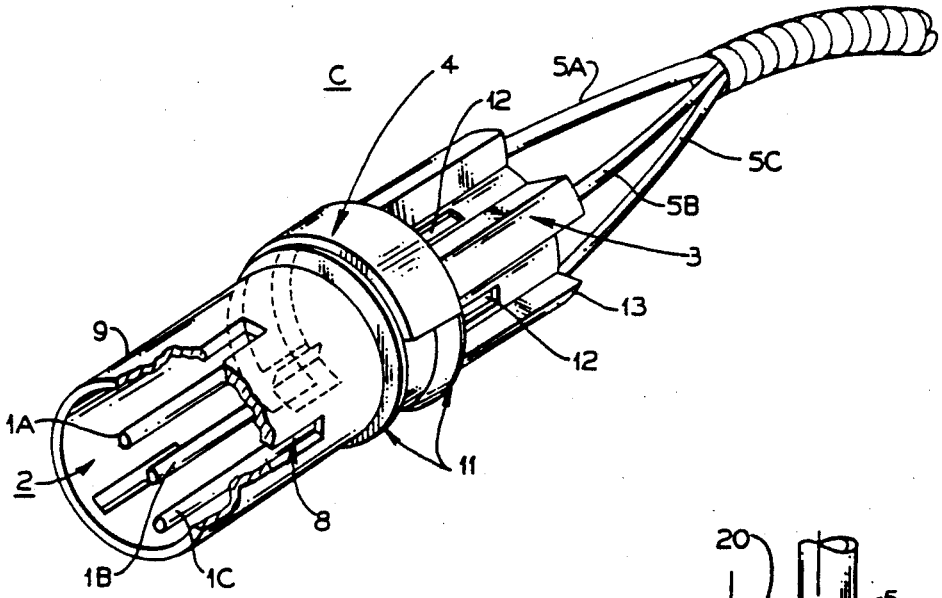
FIG. 1 is a perspective view of a typical connector assembly in which the radial lock aspects of the present invention have been applied in an exemplary manner, with all of the elements of the connector being assembled together.

The preferred, exemplary embodiment of the connector system "C" of the present invention (see FIG. 1) is a device that firmly holds an exemplary three electrical terminal pins 1A, 1B and 1C in position within the connector cavity 2 and assists in the mating of these terminals simultaneously, without having any one of these terminals pushed out of the cavity. The elements of the connector system "C" are:

a. a connector body element 3, typically made of an insulating plastic and providing an insulating housing for the terminals 1;

b. one or more metal terminals 1 (e.g. three as illustrated) for electrical continuity; and c. an externally applied radial lock element 4 for enhanced terminal retention, which can be made completely of high strength plastic, if so desired, or made with the exterior base segment of an insulating material but with the radial locking tab extensions made of metal (e.q., brass).

As is well known, a connector system such as connector system "C" is used to electrically interconnect the exemplary three wires 5A–5C of the terminals 1A–1C to mating female receptacles in a connector block (not illustrated).

The connector cavity 2 (see FIG. 2) has a provision to accept a front or rear based wedge 7 (partially illustrated), if such is desired, to support and wedge the three locking fingers 6 (an exemplary one being shown, there being one finger for each terminal pin) in their respective desired positions. However, using a wedge 7 in conjunction with the invention's radial lock 4 for some systems could be considered an over-design and may be eliminated for better economics.

CONNECTOR BODY (3)

The exemplary connector body 3 illustrated is a three-way electrical terminal insulation housing having (as can be seen in FIG. 1) an exterior wall having a cylindrical configuration in its front, lateral cross-section. It has three, longitudinally extending, latching slots 8 at the front (mating) end 9. The latching slots 8 are equidistant from each other, and these are provided for latch locking the connector body 3 to the mating block part having female receptacles (not illustrated) of the electrical connection.

Figure 4A:
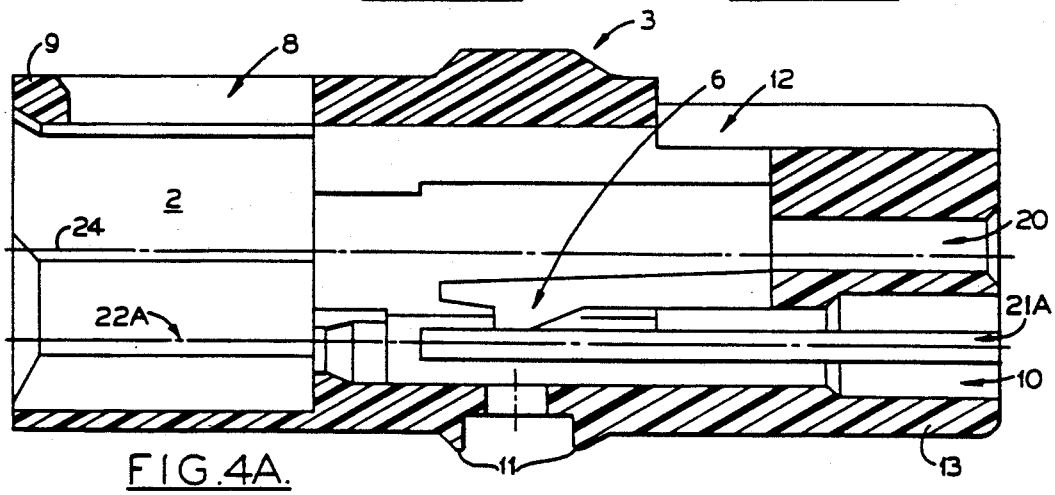
FIGS. 4A and 4B are side, cross-sectional and rear end views, respectively, of the exemplary connector body element which is used in the embodiment of FIG. 1.
Figure 4B:
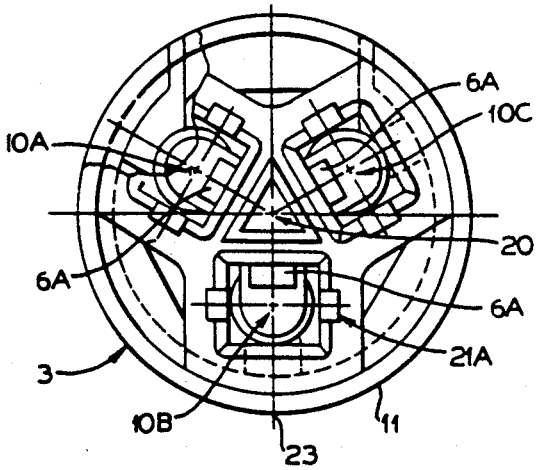

The connector body 3 also has three identical pin cavities 1OA–1OC equally spaced in a circle (see FIG. 4B). The structural part 16 (see FIGS. 5 and 6) of each terminal 1 that is essentially responsible for retention force could have either a circular, rectangular (as illustrated and preferred), combinations thereof, or other desirable cross-section. The configuration of the corresponding cavity 10 is designed accordingly.

The exemplary connector terminal cavity 10 of the exemplary embodiment has a rectangular cross-section (see FIG. 4) towards its rear. An important feature of each of the three terminal cavities 10 is the inclusion of an outwardly directed, resilient lock finger 6 (with a radially extending locking tab 6A) and a suitable opening 3A just opposite to the finger tab, through which radial tabs 42A–C on the radial lock 4 (note FIGS. 2 and 4A) can extend. These openings 3A are provided for the interconnection or communication of the radial lock 4 (see FIGS. 3A and 3B) to the female openings in the terminal pins 1A–1C, which is described more fully below.

Figure 5:
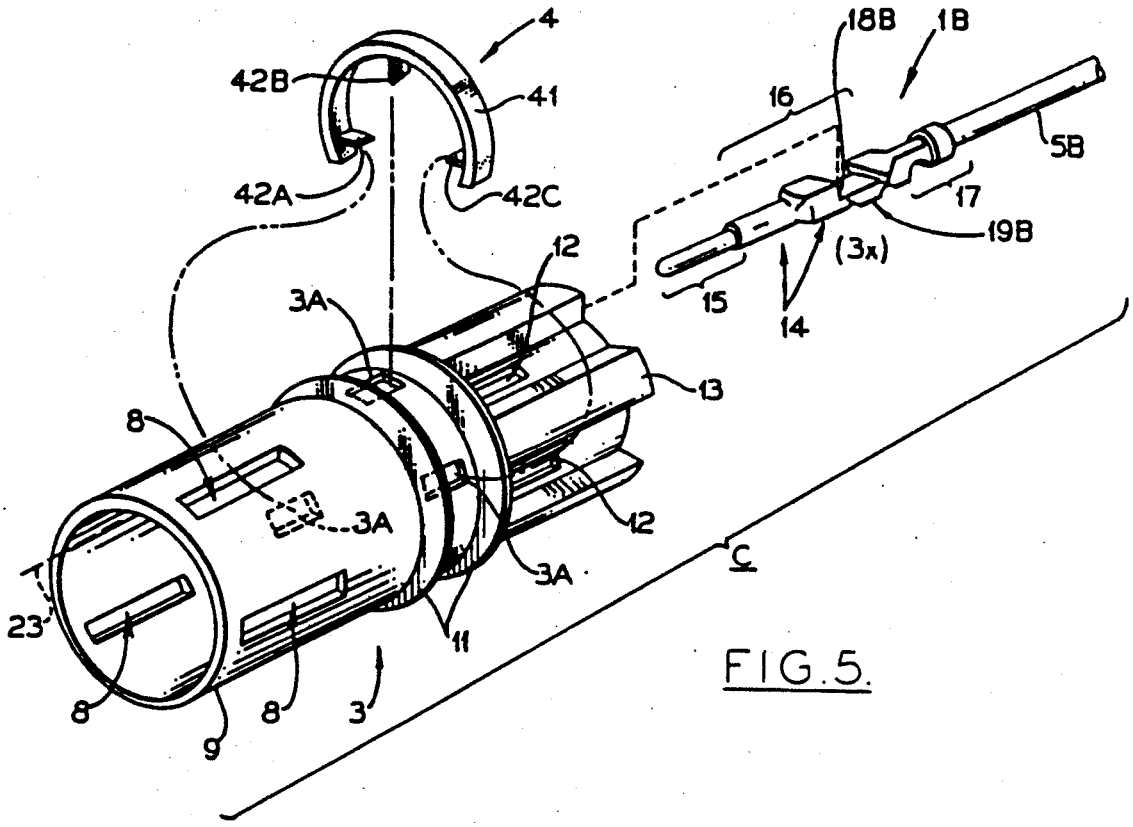
FIG. 5 is an exploded, perspective view of the connector body element and the radial lock element of the exemplary connector system of the present invention, with only one of the terminal pins being shown (the other two terminal pins not being illustrated for simplicity purposes), illustrating the interfacing of the tabs of the radial lock with the mating openings in the connector body and in the outer opening of the exemplary terminal pin at the center of the radial lock segment of FIGS. 3A and 3B.

On the outside wall of the connector body 3 there are two, circumferentially extending rails 11 running around the connector's circumference for at least about two hundred and forty degrees plus (240°+), i.e., in an arc which would at least include and straddle the three external openings 3A. It is noted that the rails are shown in FIGS. 1 and 5 as extending completely about the connector body 3, i.e, three hundred and sixty degrees (360°), while, alternatively, in FIG. 4A the rails extend only about approximately two hundred and forty degrees (240°) of the circumference of the body.

Figure 2:
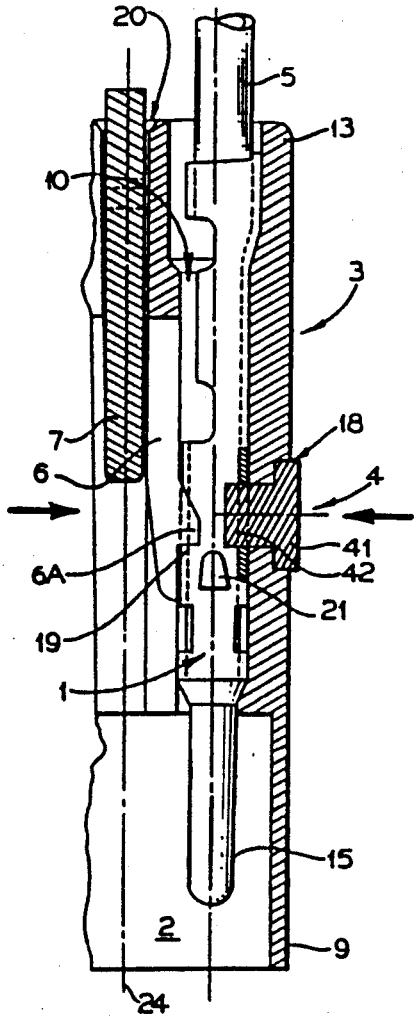
FIG. 2 is a partial, cross-section view showing one of the terminal pins in its respective terminal connector cavity of the fully assembled embodiment of FIG. 1.
Figure 3A:
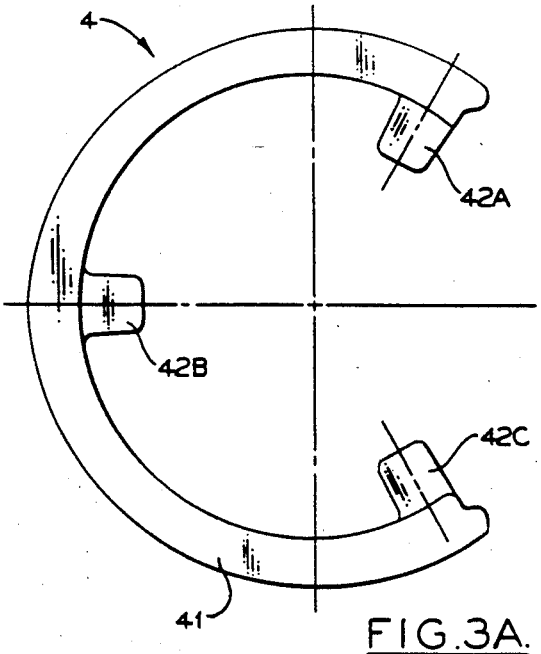
FIGS. 3A and 3B are end and side views, respectively, of the exemplary three-way radial lock element which is used in the embodiment of FIG. 1 in accordance with the principles of the present invention.

These rails 11 act as guides to longitudinally position and help install the radial lock 4 and also protect the lock 4 against improper handling. They can be in the form of rails protruding out from the exterior of the connector body 3, as shown in most of the figures, or, alternatively, as rails formed by the side walls of a depressed channel in the connector body, as shown in FIG. 2.

For the provision of using a front or rear base wedge 7, there are an exemplary three wedge retention slots 12 close to the rear edge 13 of the connector body 3. The wedge 7 has a tab (not illustrated) which fits and locks into anyone of the wedge retention slots 12, as is known to those of ordinary skill.

RADIAL LOCK (4)

Figure 3B:
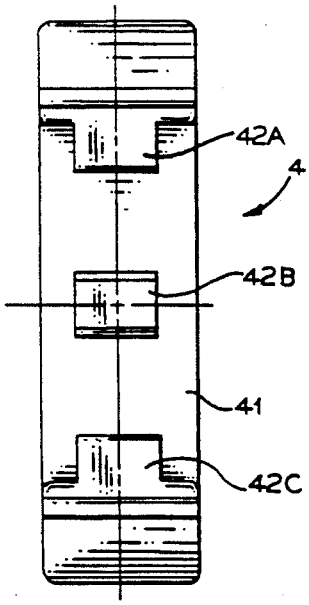

The exemplary radial lock 4 of the present invention (see FIGS. 3A and 3B) is a circular, flexible segment 41 in the form of a ring band having three, radially directed, locking tabs 42A–42C spaced a hundred and twenty (120°) degrees apart from each other. These tabs 42A–42C are centered with respect to the width of the body, i.e. its circular arc, as can be seen in FIG. 3B. The heights of the locking tabs 42A–42C are carefully determined, as an excessive height might create some interference problems and make the installation process difficult and an insufficient height would not lock the terminal pins 1 to the connector body 3.

When assembled on the connector body 3 after the terminal pins 1A–1C have been inserted into the connector body, the locking tabs 42A–C extend through the exterior openings 3A and into the outer, mating openings 18A–C, respectively, in the terminal pins (see FIGS. 2 and 5). Concurrently, the finger tab extensions 6A extend into and mate with inner openings 19A–C in the terminal pins 1A–C located opposite to the terminal pin openings 18A–0 (again note FIGS. 2 and 5). This conjunctively provides a double lock for the terminal pins 1 to the connector body 3, with the locks preferably being directly opposed, as illustrated and described.

The outer and inner, female locking openings 18, 19 and the mating male tabs 42, 6A preferably are rectangular or square in configuration. With the tabs inserted into the openings past the exterior surface of the pins 1 and into the interiors of the pins, such configurations significantly enhance the holding or retention characteristics of the terminals to the connector body 3.

If so desired, the triangularly configured, centrally located wedge 7 can be inserted into the wedge cavity 20 (see FIGS. 4B and 2) further forcing the fingers 6 against the terminal bodies for even further securement of the terminal pins 1 to the connector body 3.

TERMINAL BODY STRUCTURE (1) FOR OPTIMUM RETENTION

Figure 6:
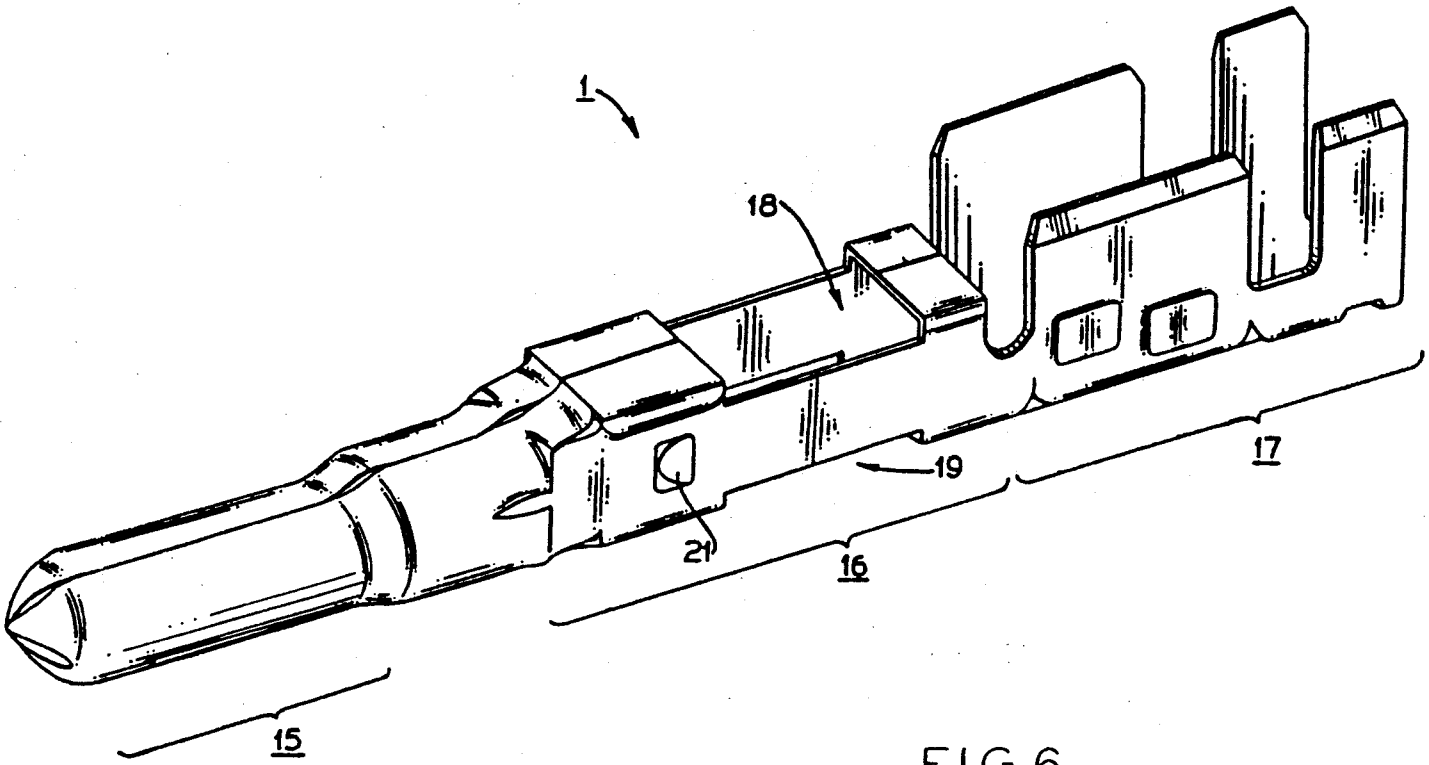
FIG. 6 is a perspective, close-up view of an exemplary terminal pin which can be used in the connector system of the present invention, with the pin being shown before it is connected to its respective wire and with a tip portion partially cut away to show the interior of front of the terminal.

Generally speaking and with reference to FIGS. 5 and 6, an electrical terminal (1) has three basic zones along its length:

1. a mating zone 15 for electrical continuity;
2. a body zone 16 that is structured to carry the mechanical load and to provide retention in the cavity; and
3. conductor and insulation grip zone 17 for wiring purposes.

For satisfactory retention the body 16 of a terminal must be structured properly, and, because the present invention provides a connector system for optimum terminal retention, a description of the preferred structures of the terminal body 17 will be provided. The possible, basic cross-sections of the terminal body 17 typically are:

1. rectangular;
2. square; and
3. circular.

All of the above versions could have constrained cross-sections. However, the first two above, namely rectangular and square, with two rectangular or square windows or openings 18 and 19 opposite to each other, provide maximum retention and are preferred, with the rectangular approach being illustrated for exemplary purposes. This configuration, along with rectangularly configured or at least flat faced locking tabs, provides a positive, orthogonal, face-to-face, direct locking engagement for securely locking the pins 1 to the connector body 3, particularly at the front edges of the female windows 18 and 19.

For further detail information on the structure and function of the terminal bodies (1A–1C), reference is had to the concurrently filed application Ser. No. 07/407,486 referred to above, the disclosure of which is incorporated herein by reference.

ASSEMBLY AND ASSEMBLY PROCESS

To assemble the connector system "0" of the present invention, the polarizing darts 21, if any (see FIGS. 2 and 6 and the above referenced companion case), of the terminals 1 are lined up with the polarizing key slots 21A (see FIGS. 4A and 4B) of the connector body 3. The terminals 1 are then pushed inside their respective cavities 10 until they are locked up and stop going forward due to the initial locking action of the tab extensions 6A popping into the inner terminal openings 19.

The ends of the resilient, radial lock ring 4 are then placed symmetrically in between the two rails 11 of the connector body 3, laterally straddling it, and the radial lock is pushed towards the center 23 of the connector body until the lock ring stops due to the tabs 42A–C entering into the openings 3A and latching into the outer, mating openings 18A–C in the pins 1A–C. This, along with the internal latching fingers, causes the terminals 1 to be retained in two ways, as can be seen in FIGS. 2 and 5, with the double locks being engaged from two opposite directions (note directional arrows in FIG. 2) and with the tips of preferably both of them being inserted into the interior of their respective terminal pin 1.

It is noted that, all during the pin insertion and seating process, the terminal pins 1A–C move in a straight line parallel to the longitudinal, centerline axis 24 of the connector body and are not forced to deviate from that direction, in contrast to the angular, down and up movement of the terminals in the Dyki patent. Thus, in further contrast to the rigid, non-moving, obstructing, arcuate wall abutment of the Dyki patent, the elastically deformable, resilient fingers 6, which provide the initial lock and seating of the pins 1A–C into the body 3, do the moving and flexing. This action does not require an increase in the exterior size or diameter of the body 3 and, yet, with the use of the exteriorly applied radial lock 4, achieves opposed double locking while maintaining subminiature sizing.

To release the separable radial lock 4, one merely needs to apply a small force, e.g. using a pin, to one end of the lock ring, and it pops out and is released. The terminal pins 1 can then be removed from the connector body 3 after removing any wedge 7 and disengaging the fingers 6 in the ordinary way.

It is noted that the exemplary radial lock 4 described above has a finite radius. However, as should be apparent, as this radius is extended out to approach infinity, the lock (4) effectively becomes linear. The present invention includes both radial and linear approaches. Either type, radial or linear, increases the terminal retention by a factor of two, if appropriately added to, for example, a connector system having a lock finger, supported (if desired) by a wedge.

The radial lock 4 and the connector body 3 preferably are not of the same material, providing substantial advantage. The material of the radial lock 4 can thus independently be selected to meet specific design requirements. The abutments, i.e. the locking tabs 42, can even be made of metal, with these metal abutments being joined together by, for example, an insert molding process. In this case, the retention force would tend to be very large, and, as a result, it would be expected that the terminals 1 would be damaged first in the event of any excessive force before they could either be pushed or pulled out.

Although this invention has been shown and described with respect to a detailed, exemplary embodiment thereof, it should be understood by those skilled in the art that various changes in form, detail, methodology and/or approach may be made without departing from the spirit and scope of this invention.

Having thus described at least one exemplary embodiment of the invention, that which is new and desired to be secured by Letters Patent is claimed below.

I claim:

1. An electrical connector system for connecting at least two wires to a female receptacle in a connector block, comprising:

at least two, longitudinally extended, terminal pins for insertion into the female receptacle; each of said pins having a terminal end portion, and a main, structurally strong, pin body, there being at least one, outwardly directed, female window opening through the exterior surface of said pin body;

a connector body having an interior and an exterior wall covering at least a part of said interior, said connector body enclosing and containing said terminal pins in its interior and having in said interior a center-line, said connector body further having separate communication openings through said exterior wall leading to said interior, each one associated with a separate one of said terminal pins, each one extending to a respective one of said terminal pins and communicating with its respective window opening; and a separable radial lock located on the exterior of said connector body on said cylindrical portion and having a base segment and a separate inwardly directed tab extension associated with a separate one of said terminal pins extending from said base segment through said exterior wall openings and extending into said female window opening of its respective terminal pin, positively locking said terminal pin to said connector body against longitudinal movement of said terminal pin with respect to said connector body;

said exterior wall including a cylindrical exterior surface in the areas surrounding and extending past said communication openings and overlying said female window openings; and said base segment of said separable lock forming a circular arc segment presenting a continuous cylindrical surface on its underside extending past said communication openings, straddling said exterior wall about and in curved face-to-face surface engagement with said cylindrical exterior surface in the areas overlying the communication openings, said inwardly directed tab extensions being radially directed toward said center-line into their respective outwardly directed female window openings.

2. The electrical connector system of claim 1 wherein each of said terminal pins has:

a terminal body including an inwardly directed, female, window opening opposite to its respective outwardly directed window opening; and wherein there is further included for each terminal body:

an elastically deformable, longitudinally extended finger in the interior of said connector body associated with a respective one of said terminal pin bodies and located on the other side of its respective pin body from said separable radial lock, each of said fingers including an outwardly directed, finger locking tab extended toward its respective terminal body extending into its inwardly directed, female, window opening, conjunctively causing with said radial lock a positive, double lock of each of said terminal pins to said connector body.

3. The electrical connector system of claim 1 wherein:

said exterior wall includes a pair of circumferentially extending, parallel, circular rails straddling said communication openings located on opposite sides of said cylindrical surface portion at side edge portions thereof locating and positioning said radial lock longitudinally with respect to said communication openings.

4. The electrical connector system of claim 1 wherein:

said connector body and said terminal pins are subminiature in size with said connector body having a diameter of the order of half an inch and said terminal pins having a diameter of the order of one and a half millimeters.

5. An electrical connector system for connecting at least three wires with each one being to a separate female receptacle in a connector block, comprising:

at least three, longitudinally extended, terminal pins for insertion into its respective female receptacle, each said pin having a terminal end portion, and a main, structurally strong, pin body, there being at least one, outwardly directed, female window opening through the exterior surface of said pin body;

a connector body having an interior and an exterior wall covering at least a part of said interior, said connector body enclosing and containing said terminal pins in its interior, said connector body having at least one communication opening for each said terminal pin through said exterior wall leading to said interior and to its respective terminal pin and communicating with said window opening of its respective pin; and a separable radial lock located on the exterior of said connector body having a base segment and at least one inwardly directed tab extension for each one of said terminal pins extending from said base segment through its respective exterior wall opening and extending into said female window opening of its respective pin, positively locking each of said terminal pins to said connector body against longitudinal movement of said terminal pins with respect to said connector body;

said separable radial lock has at least one inwardly directed tab extension for each one of said terminals, with each tab extension extending from said base segment through a respective one of said communication openings extending into its respective outwardly directed, female, window opening, said separable lock positively locking each of said terminal pins to said connector body;

said exterior wall defining a cylindrical surface in the areas surrounding said communication openings; and said base segment of said separable lock forming an arc segment, straddling said exterior wall, and said inwardly directed tab extensions being radially directed into their respective outwardly directed female window openings;

each of said terminal pins having a terminal body including an inwardly directed, female, window opening opposite to its respective outwardly directed window opening; and an elastically deformable, longitudinally extended finger in the interior of said connector body associated with a respective one of said terminal pin bodies and located on the other side of its respective pin body from said separable radial lock, each of said fingers including an outwardly directed, finger locking tab extended toward its respective terminal body extending into its inwardly directed, female, window opening, conjunctively causing with said radial lock a positive, double lock of each of said terminal pins to said connector body;

said three terminal pins being spaced about the interior of said connector body spaced from each other by one hundred and twenty degrees (120°) of a circle; and said base segment of said radial lock extending about said exterior wall at least two hundred and forty degrees (240°) of a circle.

6. The electrical connector system of claim 5 wherein:

said base segment of said radial lock is in the form of a curved, ring band with said tab extensions being radial and having rectangular cross-sections in their lateral extent and being centered with respect to the width of said ring band.

7. The electrical connector system of claim 5 wherein there is further included:

a centrally located wedge positioned along the centerline of said connector body wedging said fingers out against the inner sides of said terminal bodies.

8. The electrical connector system of claim 5 wherein:

said connector body and said terminal pins are subminiature in size with said connector body having a diameter of the order of half an inch and said terminal pins having a diameter of the order of one and a half millimeters.

9. The electrical connector system of claim 5 wherein:

said exterior wall includes a pair of circumferentially extending rails straddling said communication openings locating and positioning said radial lock longitudinally with respect to said communication openings.

10. An electrical connector system for connecting at least three wires to three female receptacles in a connector block, comprising:

at least three, longitudinally extended, terminal pins for insertion into the female receptacles; each of said pins having a terminal end portion, and a main, structurally strong, pin body, there being at least one, outwardly directed, female window opening through the exterior surface of said pin body;

a connector body having an interior and a cylindrical exterior wall covering at least a part of said interior, said connector body enclosing and containing said terminal pins in its interior, which terminal pins are spaced in a circular array about said interior, said connector body having at least three communication openings through said exterior wall leading to said interior and to a respective one of said terminal pins and communicating with its respective window opening; and a separable radial lock located on and straddling laterally across an exterior portion of said connector body and riding on said exterior wall, said radial lock having a curved, base segment and at least three, inwardly directed, radial tab extensions, one for each of said terminal pins, each one extending from said base segment through a respective one of said exterior wall openings and extending into a respective one of said female window openings, positively locking each of said terminal pins to said connector body against longitudinal movement of said terminal pins with respect to said connector body, said base segment of said radial lock is in the form of a curved, ring band; and at least three elastically deformable, longitudinally extended fingers in the interior of said connector body, one for each of said terminal pins, with each finger located on the other side of its respective pin body from said separable radial lock, each of said fingers including an outwardly directed, radial, finger locking tab extended toward its respective terminal body extending into its respective inwardly directed, female, window opening, conjunctively causing with said radial lock a positive, double lock of each of said terminal pins to said connector body.

11. The electrical connector system of claim 10, wherein:

said tab extensions have rectangular cross-sections in their lateral extent and are centered with respect to the width of said ring band of said base segment.

12. The electrical connector system of claim 10, wherein:

said base segment is made of an insulating material and said tab extensions are made of metal.

13. The electrical connector system of claim 10, wherein:

said connector body and said terminal pins are subminiature in size with said connector body having a diameter of the order of half an inch and said terminal pins having a diameter of the order of one and a half millimeters.

14. The electrical connector system of claim 10, wherein there are:

exactly three of said terminal pins spaced about the interior of said connector body spaced from each other by one hundred and twenty degrees (120°) of a circle; and wherein:

said base segment of said radial lock extends about said exterior wall at least two hundred and forty degrees (240°) of a circle.

15. The electrical connector system of claim 14, wherein there is further included:

a centrally located wedge positioned along the centerline of said connector body wedging said fingers out against the inner sides of said terminal bodies.

said connector body and said terminal pins are subminiature in size with said connector body having a diameter of the order of half an inch and said terminal pins having a diameter of the order of one and a half millimeters.

* * * * *

UNITED STATES PATENT AND TRADEMARK OFFICE

CERTIFICATE OF CORRECTION

PATENT NO. : 4,988,316

DATED : January 29, 1991

INVENTOR(S) : Dhirendra C. Roy

It is certified that error appears in the above-identified patent and that said Letters Patent is hereby corrected as shown below:

Col. 4, line 53, "e.q." should be --e.g.--

Col. 6, line 13, "18A-O" should be --18A-C--

Col. 7, line 2, "O" should be --C--

Col. 12, lines 29-33 - these lines should be deleted in their entirety.

Signed and Sealed this

Fourteenth Day of July, 1992

*Attest:*

*Attesting Officer*

DOUGLAS B. COMER

*Acting Commissioner of Patents and Trademarks*